US011820562B2

(12) United States Patent
Fernandez et al.

(10) Patent No.: US 11,820,562 B2
(45) Date of Patent: Nov. 21, 2023

(54) RESILIENT CARDBOARD CUSHIONING FOR PACKAGING

(71) Applicant: Apple Inc., Cupertino, CA (US)

(72) Inventors: Jade Fernandez, San Francisco, CA (US); Esgar Pulido-Melendrez, Cupertino, CA (US); Asena Yildiz, Jericho, NY (US)

(73) Assignee: Apple Inc., Cupertino, CA (US)

( * ) Notice: Subject to any disclaimer, the term of this patent is extended or adjusted under 35 U.S.C. 154(b) by 95 days.

(21) Appl. No.: 17/020,417

(22) Filed: Sep. 14, 2020

(65) Prior Publication Data

US 2022/0081153 A1 Mar. 17, 2022

(51) Int. Cl.
*B65D 5/50* (2006.01)
*B65D 81/05* (2006.01)

(52) U.S. Cl.
CPC ..... *B65D 5/505* (2013.01); *B65D 81/05* (2013.01); *B65D 2581/053* (2013.01)

(58) Field of Classification Search
CPC ..... B65D 5/505; B65D 5/50; B65D 81/05; B65D 81/02; B65D 81/053; B65D 81/054; B65D 2581/02; B65D 2581/05; B65D 2581/053
See application file for complete search history.

(56) References Cited

U.S. PATENT DOCUMENTS 1,852,832 A * 4/1932 Beaman ..... B65D 81/054 206/586
5,000,376 A * 3/1991 Wojdyla ..... B65D 5/505 410/121
5,378,096 A * 1/1995 Keenan ..... B63B 25/24 206/593
6,012,587 A * 1/2000 McCullough ..... B65D 81/054 493/137
7,452,316 B2 * 11/2008 Cals ..... B65D 81/127 206/594
8,753,731 B2 * 6/2014 Dunn ..... B65D 81/056 428/116

* cited by examiner

*Primary Examiner* — Javier A Pagan
(74) *Attorney, Agent, or Firm* — Sterne, Kessler, Goldstein & Fox P.L.L.C.

(57) ABSTRACT

Packaging may include cushioning components. Cardboard corrugate cushioning elements may be configured with a folded cardboard spring, lateral stability wrap, and stiffening element. The cushioning components may include mechanical bends formed as creases, that provide resistance to deformation, thereby allowing the cushioning component to absorb impact and vibration, and replacing the need for less environmentally friendly cushioning, such as expanded polystyrene or foam cushioning.

20 Claims, 9 Drawing Sheets

RESILIENT CARDBOARD CUSHIONING FOR PACKAGING

FIELD

The described embodiments relate generally to packaging. More particularly, the present embodiments relate to packaging using folded cardboard configured as springs retained within a support wrap made from folded cardboard, such that a cushioning effect is produced during an impact.

BACKGROUND

The described embodiments relate generally to packaging. More particularly, the present embodiments relate to packaging using folded cardboard configured as springs retained within a support wrap made from folded cardboard, such that a cushioning effect is produced during an impact. Product packaging is an integral part of a customer's experience. It introduces the customer to their product, and can affect the customer's feelings toward the product and the company that created it. This is especially true for companies that wish to move toward a single stream recycling solution for their packaging. In general, current high performing cushioning structures usually are made of plastic materials such as expanded polystyrene. While these materials provide adequate cushioning, they are not environmentally friendly and use nonrenewable resources for their raw material.

In contrast, some more environmentally friendly materials such as molded fiber or cardboard structures may be prone to permanent deformation. While these materials may absorb the energy of a single impact, past components risk losing their dimensions, absorption and retention properties, etc. after a single or very few impacts. If a company wishes to use materials such as cardboard in these types of applications, a past solution would be simply to add additional layers, etc. that add both weight and cost. This weight and cost still may not realize the benefit of elastic properties, e.g., when used to support certain products or finished goods boxes. And in the case of finished goods boxes that also use environmentally friendly materials (e.g., cellulose based materials), additional cushioning is further desirable to enhance the robustness in terms of impact and vibration protection, particularly with larger products that use the most foam-type cushioning.

What is needed is a cardboard cushioning paradigm that can absorb repetitive impacts while maintaining shape through design innovations that give the finished components elastic properties similar to expanded polystyrene, foams, etc.

SUMMARY

In some embodiments, packaging is disclosed that includes a cardboard cushion component. The cardboard cushion component includes a folded cardboard spring portion that is deflectable, and a folded cardboard stability wrap portion that surrounds the folded cardboard spring portion and is in contact with terminal ends of the folded cardboard spring. The cardboard cushion component also includes a stiffening element formed from cardboard and configured to increase the stiffness of the cardboard cushion component. In some embodiments, the cardboard cushion component is formed from a single sheet of cardboard corrugate. The folded cardboard spring portion may include a plastically deformed crease. Packaging described herein may include a plurality of the cardboard cushioning components arranged within a box and collectively supporting at least one product. In some embodiments, the box may be a finished goods package. In some embodiments, the product may be a finished goods package. In some embodiments, the packaging may house multiple products, and the cushioning component may support a plurality of products.

The folded cardboard spring portion includes zig-zag folds in some embodiments, and each folded edge of the folded cardboard spring portion comprises a plastically deformed crease on an inner surface of the fold. In some embodiments the cardboard cushion component further comprises an upper and lower loading surface, wherein the upper and lower loading surfaces are connected by upper and lower panels connected by a fold. In some embodiments, the cardboard cushion component further comprises an upper and lower loading panels, wherein the upper loading panel is connected to an upper side panel, the lower loading panel is connected to a lower side panel, each at a fold, wherein a first stiffening element is cut out from adjacent portions of the upper loading panel and upper side panel, wherein the stiffening element is folded the opposite way as the fold between the upper loading panel and upper side panel.

The folded cardboard stability wrap includes a folded tab configured to engage an aperture formed through the cardboard spring as a mechanical lock, in some embodiments. The packaging does not use adhesive to form the cardboard cushion component, in some embodiments.

In some embodiments, a cardboard cushion component include a cardboard spring having a perimeter. The cardboard spring perimeter may include, an upper panel, a second panel extending inward from a first end of the upper panel, a third panel extending inward from a second end of the upper panel, a fourth panel extending outward from the second panel, a fifth panel extending outward from the third panel, and a lower panel positioned parallel to the upper panel and extending from the fifth panel. In some embodiments, the cardboard cushion component includes a cardboard retention wrap provided around the cardboard spring and engaged with the upper and lower panels of the cardboard spring. The cardboard cushion component may include a cardboard stiffening element that stiffens the cardboard cushion. In some embodiments, the second, third, fourth, and fifth panels do not contact the cardboard spring —e.g., there is separation between the sides of the spring and the retention wrap. The cardboard cushion component is formed from a single sheet of cardboard corrugate in some embodiments. In some embodiments, the cardboard spring portion comprises a plastically deformed crease.

The cardboard retention wrap may include an upper panel in contact with the cardboard spring's upper panel, a second panel extending inward from a first end of the retention wrap's upper panel, a third panel extending inward from a second end of the retention wrap's upper panel, a fourth panel extending outward from the retention wrap's second panel, a fifth panel extending outward from the retention wrap's third panel; and a lower panel positioned parallel to the retention wrap's upper panel and extending from the retention wrap's fifth panel, the retention wrap's lower panel in contact with the spring's lower panel. In some embodiments, the first, second, third, fourth, and fifth panels of the cardboard retention wrap are in contact with the first, second, third, fourth, and fifth panels of the cardboard spring, respectively.

In some embodiments, a cardboard cushion component includes a first cardboard panel configured to be downwardly movable, and a second cardboard panel coupled to the first cardboard panel via a plurality of plastically deformed folds. In some embodiments, the cardboard cushion component is configured such that the first and second product support surfaces are substantially coplanar in a first configuration at a first distance, wherein when a predetermined force, in excess of the product initial loading, is applied downward to the first cardboard panel and released, the first cardboard panel rebounds to at least 90% of the first distance.

The cardboard cushion component includes a cardboard stability component in some embodiments. The cardboard stability component includes a first component fixed to the first cardboard panel, and a second component fixed to the second cardboard panel, whereby the cardboard stability component prevents lateral motion of the first and second cardboard panels.

In some embodiments, a packaging system may include first and second cardboard cushioning components. A first cardboard cushion component's first cardboard panel and second cardboard panel may have a first surface area, and a second cardboard cushion component's first cardboard panel and second cardboard panel may have a second surface area larger than the first surface area. The first cardboard cushion component supports a product surface having a larger surface area than a product surface supported by the second cardboard cushion component, in some embodiments. Each of the cardboard cushion components may be formed from a separate single sheet of cardboard corrugate, respectively. A plurality of first and second cardboard cushion components may be positioned around a product such that they may absorb deflection along a plurality of directions. In some embodiments a plurality of first and second cardboard cushion components are arranged in an array within a box. One or more or each of the cardboard cushion components is hidden from the customer in use by a wall of the packaging system, in some embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
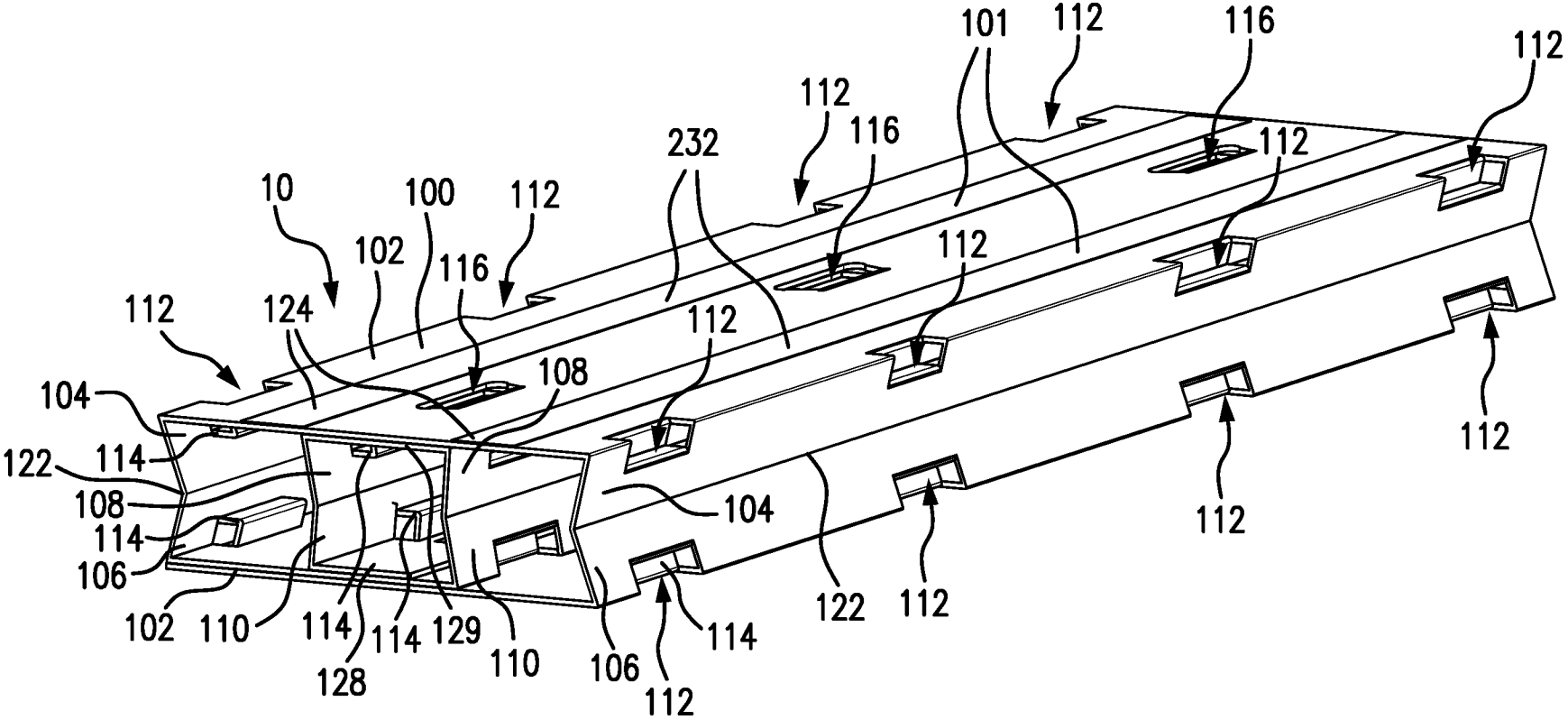
FIG. 1 shows a top isometric view of a packaging component in an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As described above, the packaging described herein provides a cushioning solution utilizing environmentally friendly materials, specifically cardboard (or other cellulose-based material). Cushioning elements are described that achieve cushioning properties via cardboard springs within lateral stability wraps, with a provision for stiffening elements to be included, depending on the design specifications. In general, the cardboard springs absorb impact energy through the folds, thereby increasing the time of product deceleration during an impact. The lateral stability wrap may also include spring features, further increasing the effectiveness of the cushioning.

Some embodiments include packaging including a cushioning element comprising cardboard, e.g., cardboard corrugate. The cushioning element includes a folded spring element configured such that an impact is absorbed. The cushioning element may be formed from a single blank, folded around itself to constrain the spring element within a lateral stability wrap. The spring elements and resulting cushioning elements described herein provide an alternative to foam type cushions used in packaging designs.

In some embodiments, each panel of the cushioning element may from a continuous sheet (e.g., a cardboard blank). The respective elements may be formed of the same material or different materials (e.g., different cellulose-based material). For example, the stability wrap may be made from molded fiber, and the springs and/or stiffening features may be made from cardboard (e.g., corrugated cardboard).

A finished package may include other components such as a lower box or tray, a lid, or additional end cap/cushioning elements. The lower box may wholly envelop the bottom surface of the cushioning element such that it is not visible to a customer. The cushioning element may hold or support a finished product, a finished good box, or the like.

Advantageously, this improves upon prior systems having, for example, expanded polystyrene components, that are less environmentally friendly than cardboard components. By designing appropriate cushioning elements using cardboard by taking advantage of the compound design elements of the cushioning described, impact resistance and elasticity can be achieved through cardboard components. Components described herein may provide a completely fiber based alternative to traditional expanded polystyrene, foam, or flexible retention film shipper designs used in previous packaging.

Companies may be sensitive to the cost of packaging and may wish to promote packaging that is eco-friendly. Certain packaging materials are higher cost due to their processing, and while engineers may be able to design single-component packaging, the cost may be prohibitive for certain materials. Optimization of packaging in material usage may help keep costs low, and if done well may not interfere with, and may promote, a positive user experience. Packaging made out of recyclable and/or biodegradable materials, such as paper or other cellulose-based products can reduce environmental impact. Packaging that is interesting in character and well-executed may boost a product's or a brand's reputation, thereby attracting new customers and retaining previous customers.

In utilizing eco-friendly materials such as cardboard structures, prior designs may be more prone to permanent deformation during shipping. Packaging described herein improves on past designs, and provides eco-friendly components that may absorb multiple impacts due to their resilient design, and protect against potentially harmful vibrations during shipping—without adding additional components or complex substructures. Packaging described in this document achieves these and other beneficial characteristics by balancing structural robustness, eco-friendly materials, and aesthetic elements.

To keep the product protected and secure during transport, handling, or storage, the cardboard cushioning element may include recesses or features to hold various components, documents, or products. A lid or other cushioning element for example may cover the product when the packaging is closed. A product contained by the packaging may be, for example, an electronic device such as, for example, a desktop, monitor, laptop, tablet computer, or smartphone, or it may be a non-electronic device.

In some embodiments, the packaging may be retail packaging (i.e., finished packaging for containing and conveying a product to a user such as may be used in a retail setting, not shipping packaging for containing a packaged product during shipment) that one may expect to find on the shelf in a retail store, and which one may open after purchase to directly access their product.

These and other embodiments are discussed below with reference to the accompanying figures. However, those skilled in the art will readily appreciate that the detailed description given herein with respect to these figures is for explanatory purposes only and should not be construed as limiting.

Figure 2:
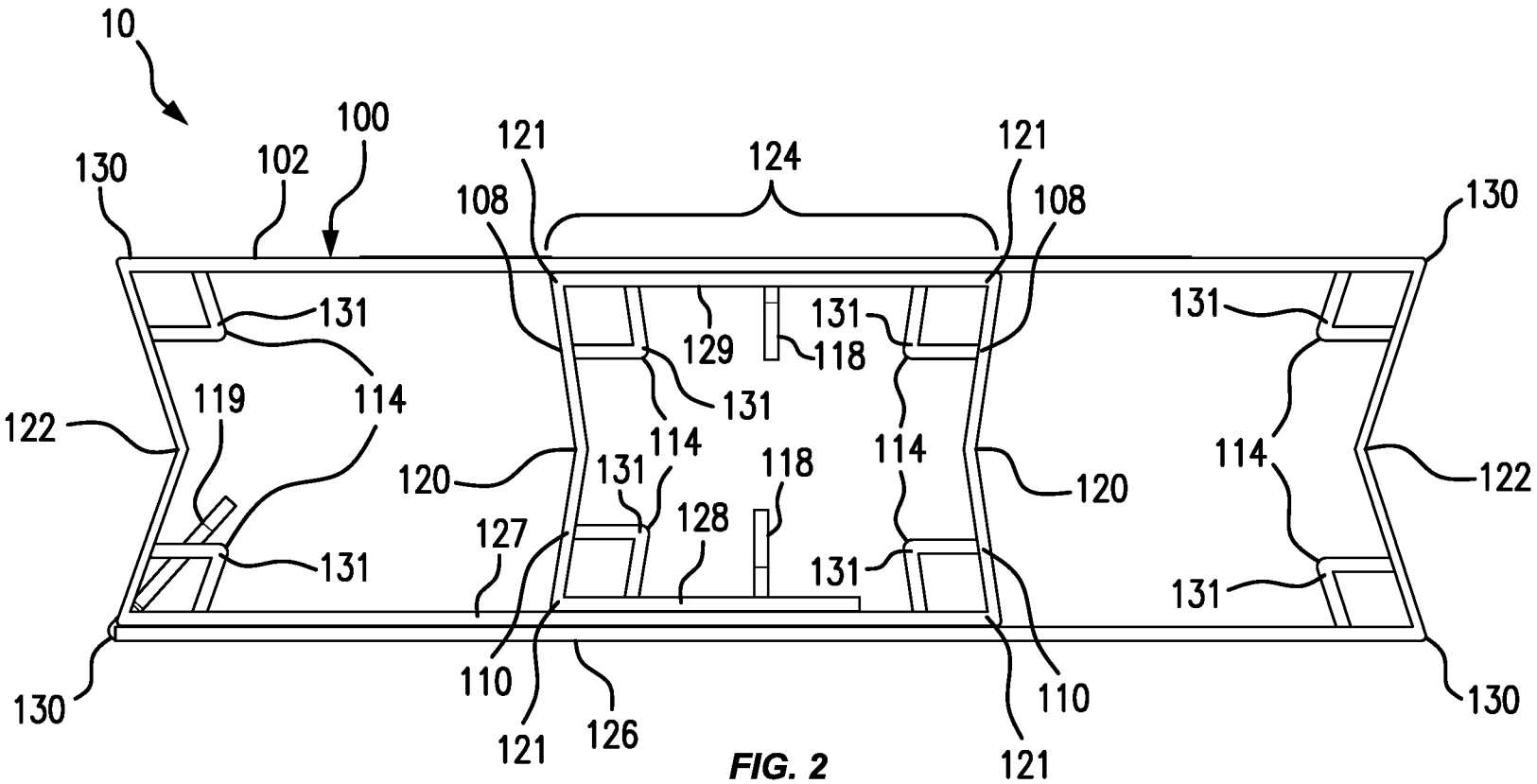
FIG. 2 shows a front view of the packaging component shown in FIG. 1.

FIGS. 1 and 2 show a top isometric and front, respectively, of packaging 10 including cushioning element 100 according to some embodiments. Cushioning element 100 includes upper and lower loading surfaces 102, that deflect relative to one another in response to a loading force, e.g., from a drop event or vibration when a product is engaged with a loading surface 102.

In some embodiments, loading surfaces may be enclosed in an outer covering, such that cushioning element 100 is hidden in use from a customer. In some embodiments, cushioning element 100 includes one or more adhesive portions 101, such that it may be fixed within a compartment of the packaging. Alternatively, cushioning element may be sized such that it may be housed and floating within a compartment such that no adhesive is used. Cushioning element 100 includes a spring portion 124, including upper panels 108 and lower panels 110, configured to pivot at folds 120. The bending resistance provided by fold 120 acts as a spring, and biases upper and lower loading surfaces 102 away from one another. Upper panels 108 engage with upper loading surface 102, e.g., via an additional panel 129 parallel to loading surfaces 102; similarly, lower panels 110 engage with lower loading surface 102, e.g., via an additional panel parallel 128 to loading surfaces 102. This engagement provides the spring force that provides a portion of the resilient action of the cushioning element 100. The loading surfaces 102 are deflectable, e.g., movable downward.

Cushioning element 100 also includes a stability wrap feature, e.g., a structure that laterally constrains and supports the spring portion. As shown in FIG. 1, this may be provided by upper and lower loading surfaces 102, and upper panels 104, and lower panels 106, effectively encircling the spring portion described above. As shown, similar to the upper panels 108 and lower panels 110, panels 104 and 106 are configured to pivot at folds 122, and provide additional bending resistance and spring force to bias upper and lower loading surfaces 102 away from one another. By incorporating a stability wrap feature, such as the one shown in FIG. 1, the spring portion 124 is laterally constrained, and supported such that they are fixed in a particular orientation but free to deflect in response to an applied force. The stability wrap may be attached and fixed to the spring by adhesive for example, or by mechanical locks such as those formed by aperture 116 and tab 118 as shown in FIGS. 1 and 2, respectively. By including the upper and lower panels 104 and 106, additional bending resistance may be provided.

Figure 3:
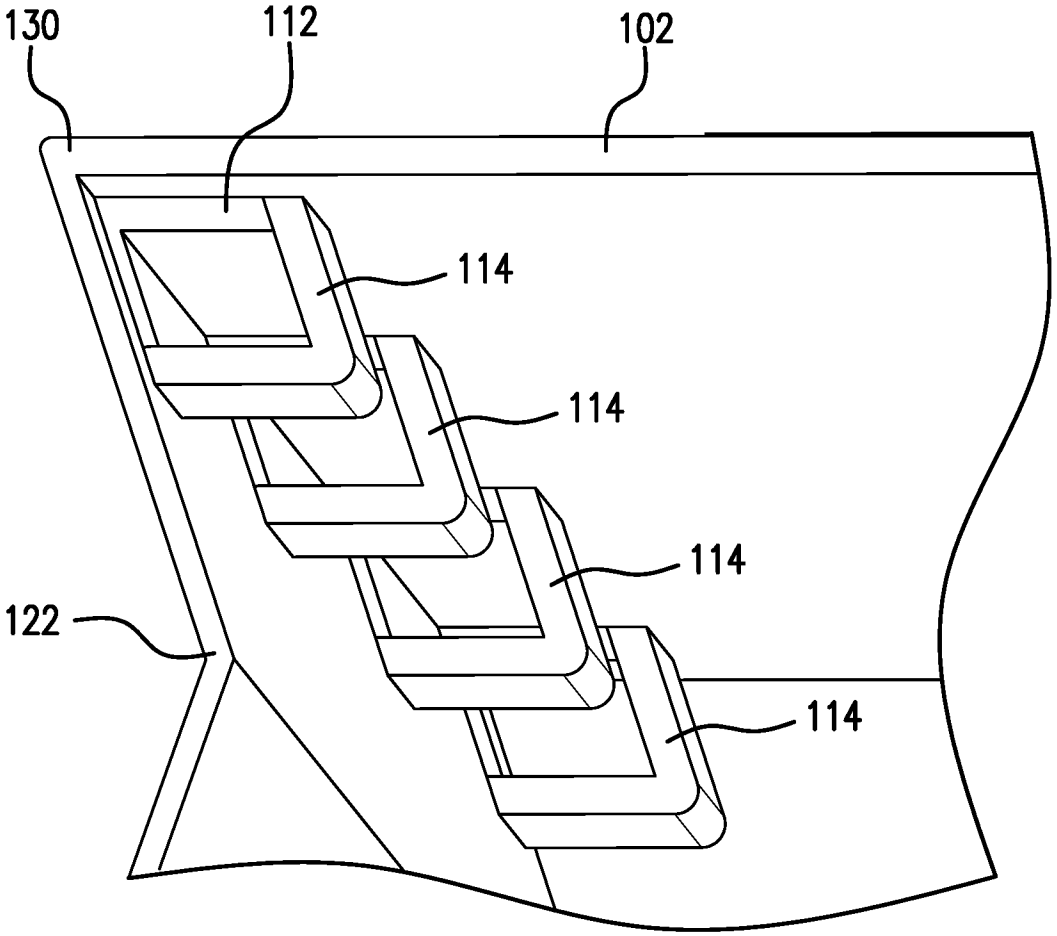
FIG. 3 shows an enlarged view of the inside corner of the packaging component shown in FIG. 1.

In some embodiments cushioning element 100 also include stiffening features, such as those formed by cutouts 112 and folded tabs 114. As shown in the figures, tabs 114 include an additional fold, whereby opposing panels are biased away from one another, further increasing the stiffness of the overall cushioning element. Stiffening features as described herein increase stiffness of the cushioning element, e.g., by adding stiffness to one or more of the spring portions or stability wrap. As one example, the upper most folded tab 114 is connected to upper panel 104 or 108, and engaged with either the upper loading surface 102 or upper surface of a spring portion, respectively. At each attachment, folded tab 114 includes an additional fold 131, that biases folded tab 114's portions open, that is away from each other, thereby providing additional resilience to the cushioning element 100 without any additional separate component or structure. While folded tabs 114 as shown may be machine punched, alternate stiffening structures are contemplated, such as folded tabs at opening ends of the cushioning elements (see tab 1014 at FIG. 10). As shown, spring portion 124 includes zig-zag folds. In some embodiments, each folded edge of the folded cardboard spring portion 124 includes a plastically deformed crease on an inner surface of the fold. Stiffening elements such as folded tab 114 may be cut out from adjacent portions of the upper loading panel 102 and upper side panel 104, wherein the stiffening element is folded the opposite way as the fold between the upper loading panel and upper side panel, Turning to FIG. 2, cushioning element 100 may be formed from a single folded blank. Starting from lowermost panel 126, the cushioning element 100 is formed outward towards the right side of the figure, folding up at the first fold 130, and continues on in a counterclockwise fashion such that the spring portion 124 is rotated inward and housed within the lateral stability wrap feature. As shown, the upper panel 129 engages upper loading surface 102, and lower panel 128 of the spring portion engages panel 127, which bridges the stability wrap and spring portions of cushioning element 100. Lower tab 118 is connected to panel 126, and is locked through apertures in panels 127 and 128. Similarly, upper tab 118 is locked through an aperture in panel 129, and is connected to the upper loading surface 102. At the lower left corner of FIG. 2, tab 119 is shown, that couples panel 126 through an aperture proximate the lower left fold 130, thereby fully fixing cushioning element 100 via mechanical locks, without additional adhesive. As shown in FIG. 2, right most upper panel 108 is configured as a second panel extending inward from a first end of the loading panel interface, and lower panel 110 on the right most side extends inward from a second end of the upper panel 108. This is shown in mirror image on the left side of spring portion 124, with the fourth panel extending outward from the second panel, a fifth panel extending outward from the third panel, and a lower panel positioned parallel to the upper panel and extending from the fifth panel. In FIGS. 1, 2, and 3, the second, third, fourth, and fifth panels do not contact the cardboard spring—e.g., there is separation between the sides of the spring and the retention wrap in cushioning component 100. The cardboard cushion component is formed from a single sheet of cardboard corrugate in some embodiments.

As shown in FIG. 2, each of folds 120, 121, 122, 130, along with folded tabs 114 provide spring force such that the upper and lower loading surfaces of cushioning element 100 are biased away from one another in an unloaded state. In a loaded state, each of these folds deform such that the upper and lower loading surfaces of cushioning element deflect toward one another, and decelerate a product, cushioning during an impact event such as a drop event for example.

Figure 4:
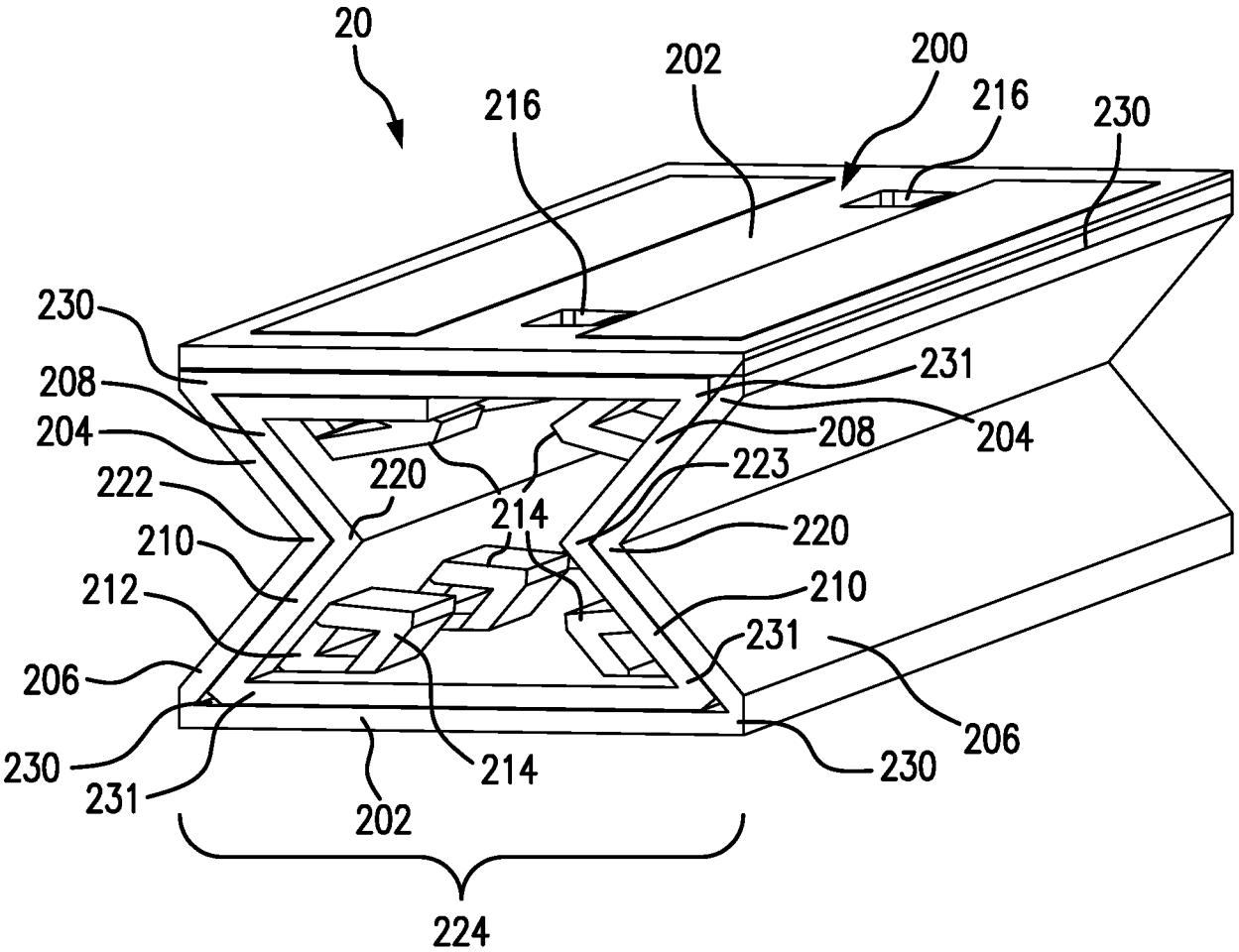
FIG. 4 shows a top isometric view of a packaging component in an embodiment.

FIG. 4 shows a top isometric view of packaging 20 including cushioning element 200 according to some embodiments. As with cushioning element 100, cushioning element 200 includes upper and lower loading surfaces 202 that deflect relative to one another in response to a loading force when a product is engaged with a loading surface 202. In some embodiments, loading surfaces may be enclosed in an outer covering, such that cushioning element 200 is hidden in use from a customer. In some embodiments, cushioning element 200 includes one or more adhesive portions 201, such that it may be fixed within a compartment of the packaging. Alternatively, cushioning element may be sized such that it may be housed and floating within a compartment such that no adhesive is used.

As with cushioning element 100, cushioning element 200 includes a spring portion 224, including upper panels 208 and lower panels 210, configured to pivot at folds 220. The bending resistance provided by fold 220 acts as a spring, and biases upper and lower loading surfaces 202 away from one another in an unloaded state. Upper panels 208 engage with upper loading surface 202, e.g., via an additional panel parallel to loading surfaces 202; similarly, lower panels 210 engage with lower loading surface 202, e.g., via an additional panel parallel to loading surfaces 202. This engagement provides the spring force that provides a portion of the resilient action of the cushioning element 200.

Cushioning element 200 also includes a stability wrap feature, though it appears differently as shown in FIG. 4 as compared to the stability wrap feature of cushioning element 100. Instead of an open space on either side of the spring portion, the panels of the stability wrap portion are in close contact with the panels of the spring portion 224. In effect, cushioning element 200 has additional stiffness imparted by the stability wrap feature along with the lateral stability improvement in constraining the spring portion. The stability wrap portion of cushioning element 200 may be provided by upper and lower loading surfaces 202, and upper panels 204, and lower panels 206. In this way, the spring portion is similarly encircled, and provides additional bending resistance and spring force. Panels 204 and 206 are configured to pivot at folds 220, and provide additional bending resistance and spring force to bias upper and lower loading surfaces 202 away from one another in an unloaded state. The panel wrapping description applied to cushioning element 100 equally applies to cushioning element 200, however as shown, the spring portion 224 and stability wrap may be in contact in cushioning element 200 along an entire perimeter of the spring portion 224.

The design paradigm of cushioning element 200 operates on similar principles as the cushioning element 100—by incorporating a stability wrap feature, the spring features are laterally constrained, and supported such that they are fixed in a particular orientation but free to deflect in response to an applied force. Each of the stability wrap features described herein may be attached and fixed to the spring by adhesive for example, or by mechanical locks such as those formed by aperture 216 and tab 218. In some embodiments, the stability wrap feature may be folded oppositely to the spring portion (i.e., bending outward, such that the outer panels form a fold pointing outward from a plane of the loading surfaces. In this way, the stability wrap feature forms a type of diamond shape. In some embodiments, the spring portion may include additional folds, and may be configured such that the directions the folds are oriented in are symmetrical or asymmetrical.

Cushioning element 200 also includes stiffening features, such as those formed by folded tabs 214. As shown in the figures, tabs 114 include an additional fold, whereby opposing panels are biased away from one another, further increasing the stiffness of the overall cushioning element, as described above with respect to tabs 114. As shown, folded tabs 214 may be formed from the panel of the spring portion, stability wrap features, or both.

Cushioning element 200 may be formed from a single folded blank. The uppermost panel as shown in FIG. 4 extends outward towards the right side of the figure, folding down at the first fold 230, and continues on in a clockwise fashion such that the spring portion is rotated inward and housed within the lateral stability wrap feature. As shown in FIG. 4, each of folds 220, 223, 230, and 231, along with folded tabs 214 provide spring force such that the upper and lower loading surfaces of cushioning element 200 are biased away from one another in an unloaded state. In a loaded state, each of these folds deform such that the upper and lower loading surfaces of cushioning element deflect toward one another, and decelerate a product, cushioning during an impact event such as a drop event for example.

Figure 5:
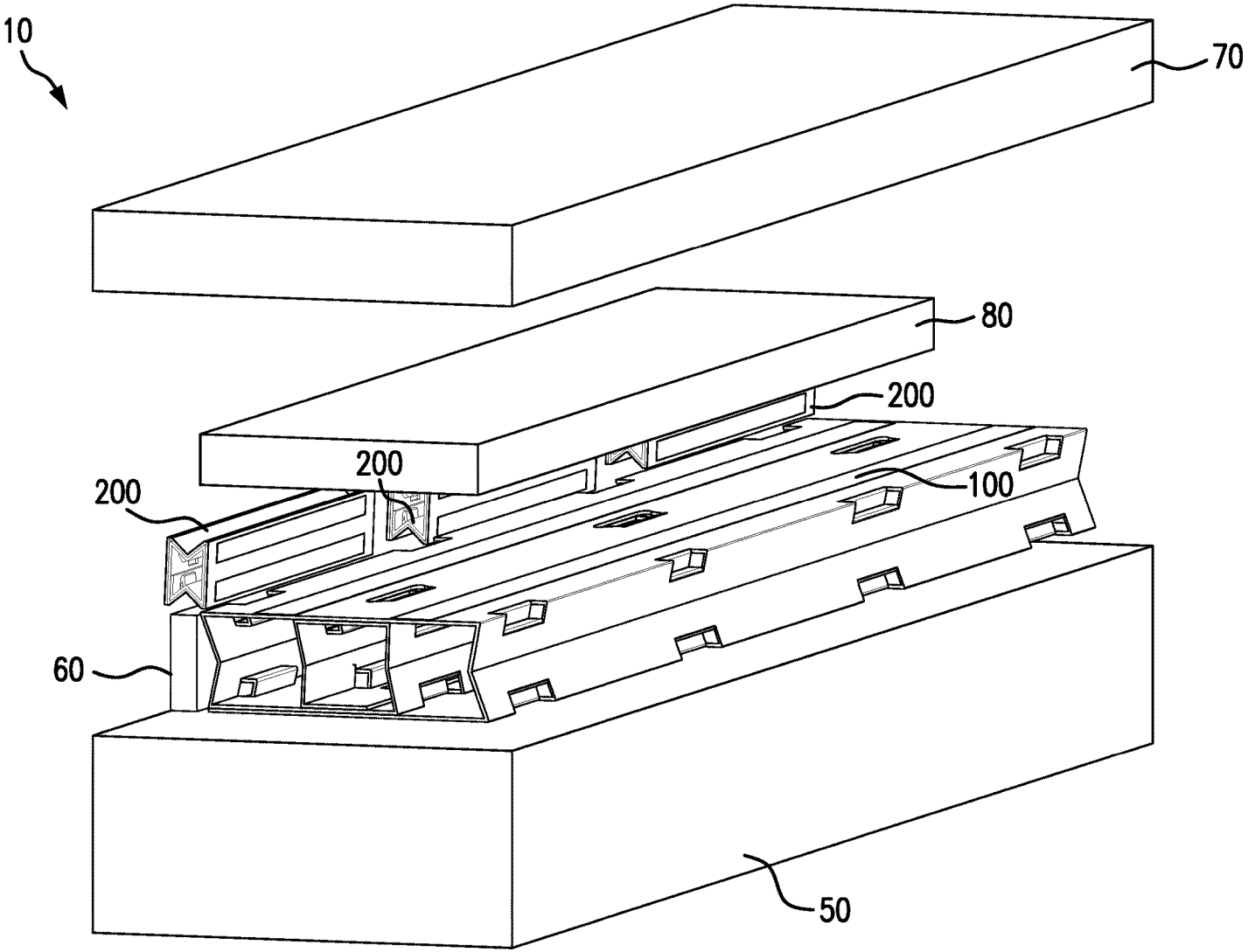
FIG. 5 shows an exploded top isometric view of packaging including the packaging components shown in FIGS. 1 and 4, and shows a product held by the packaging.

Turning to FIG. 5, packaging 10 may include one or more of cushioning elements 100/200, or other variations of the cushioning elements described herein. In some embodiments, packaging 10 holds product 50, with cushioning elements 100/200 being positioned within packaging 10 such that product 80 is supported. Packaging 10 may include additional components such as supports 60, which may not have a cushioning function. In some embodiments, cushioning elements 100/200 are disposed in a base box 50, and are enclosed within a lid 70 when the packaging is closed. All packaging described herein may also include, for example, a lid, a tray, support structures, base box, etc. In some embodiments, a first cushion component may at least partially enclose an upper portion of a product, and a second cushion component may at least partially enclose a lower portion of the same product, such that the components form end caps for the product.

As shown in FIG. 5, the cushioning elements described herein are designed as a modular component. In some embodiments, one or more specific cushioning elements may be used to provide cushioning and support to a product within a package, and may be placed in a modular fashion around the product. In some embodiments, cushioning elements described herein may be applicable to packaging for different products, and may be placed within packaging at different positions depending on which product is to be packaged. In this way, a modular packaging solution is provided, with the cushioning components being modular.

Figure 7:
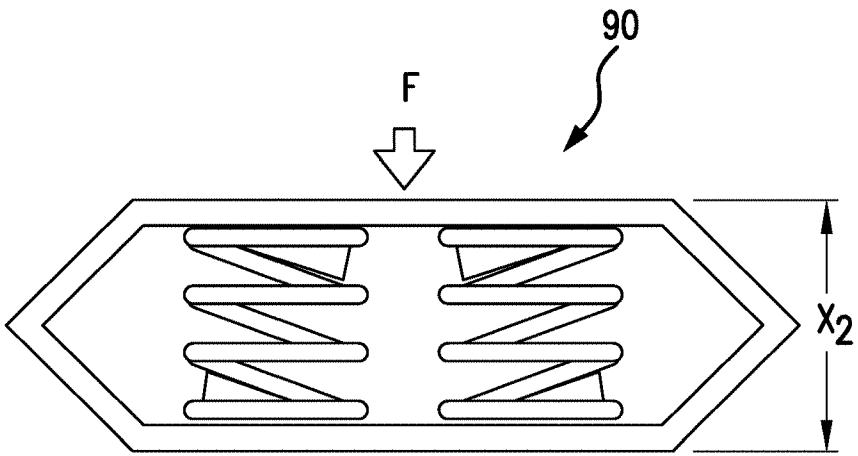
FIG. 7 shows the schematic view of the packaging component shown in FIG. 6 in a deformed state.
Figure 6:
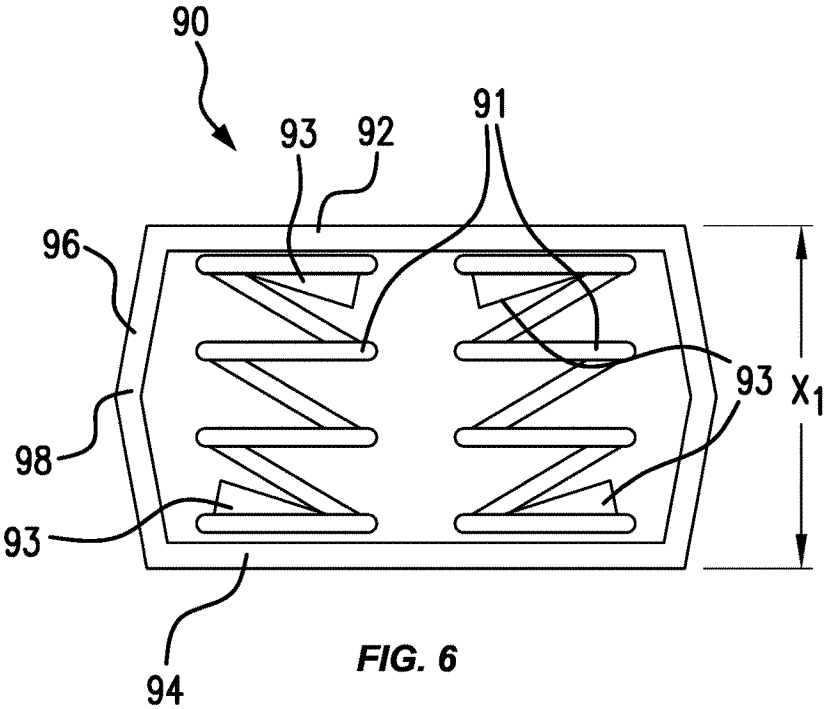
FIG. 6 shows a schematic view of a packaging component in a first state.

FIGS. 6 and 7 show simplified schematic views of a cushioning component 90, to illustrate the elements of cushioning components 90. Cushioning component 90 is representative of both of cushioning components 100/200, just shown schematically to help illustrate their operation.

As shown, cushioning element 90 includes upper loading surface 92 and lower surface 94, whereby the spring components 91 bias the surfaces away from each other in a preloaded state characterized by distance X1. In FIG. 7, force "F" is applied downward (e.g., in a drop event or vibration), and springs 93 deflect, such that the distance between upper loading surface 92 and lower surface 94 is characterized by a shorter distance X2. The side surfaces 96 and 98 also provide additional stability and spring force, resisting the loading. And finally, stiffening elements 93 add additional resistance to deflection. In some embodiments, stiffening elements 93 may be configured such that they only resist deflection after a predetermined deflection of spring elements 91, e.g., through actuation by contact between opposing surfaces of spring elements 91.

As shown in FIGS. 6 and 7, distance X1 provides that if a product supported by the cushioning component 90 transmits a downward impact force on the loading surface, e.g., if the packaging is dropped, cushioning component 90 provides elasticity and protection during an impact event. The resilience imparted by the structure of the cushioning components described herein provide for absorbing an impact without damage to the cushioning elements. This resilience may be improved via plastic deformation of the cardboard at one or more of the folds of the cushioning component via a crease, as described below with reference to FIG. 8.

Turning to FIG. 7, an exaggerated cross-section schematic is shown of cushioning component 90 showing a second, flexed configuration. The configuration shown in FIG. 7 shows a flexed configuration, whereby cushioning component 90 is shown to absorb a force shown as a downward arrow annotated as element "F" (for example an impact or vibration) downward from a product, such as during a drop event. As shown in FIG. 7, in this configuration vertical distance X2 is less than vertical distance X1 shown in FIG. 6. This is because the spring portions and stability wrap absorb the impact elastically and return to their original position or nearly to their original position when the impact is finished (i.e., deflection experienced by cushioning component 90 is less than an amount that would cause further permanent deformation in the form of creasing). In the case of smaller impact events or vibrations, the dimensional variation X1 to X2 may be imperceptible to an observer. Moreover, depending on the overall dimensions of the packaging 10 and materials selected, these dimensions and other parameters described herein may be varied such that for representative impact events such as drops, the product held by the packaging experiences peak acceleration of less than a predetermined threshold. In some embodiments, the cardboard cushion component is configured such that the first and second product support surfaces are substantially coplanar in a first configuration at a first distance, wherein when a predetermined force, in excess of the product initial loading, is applied downward to the first cardboard panel and released, the first cardboard panel rebounds to at least 90% of the first distance.

Figure 8:
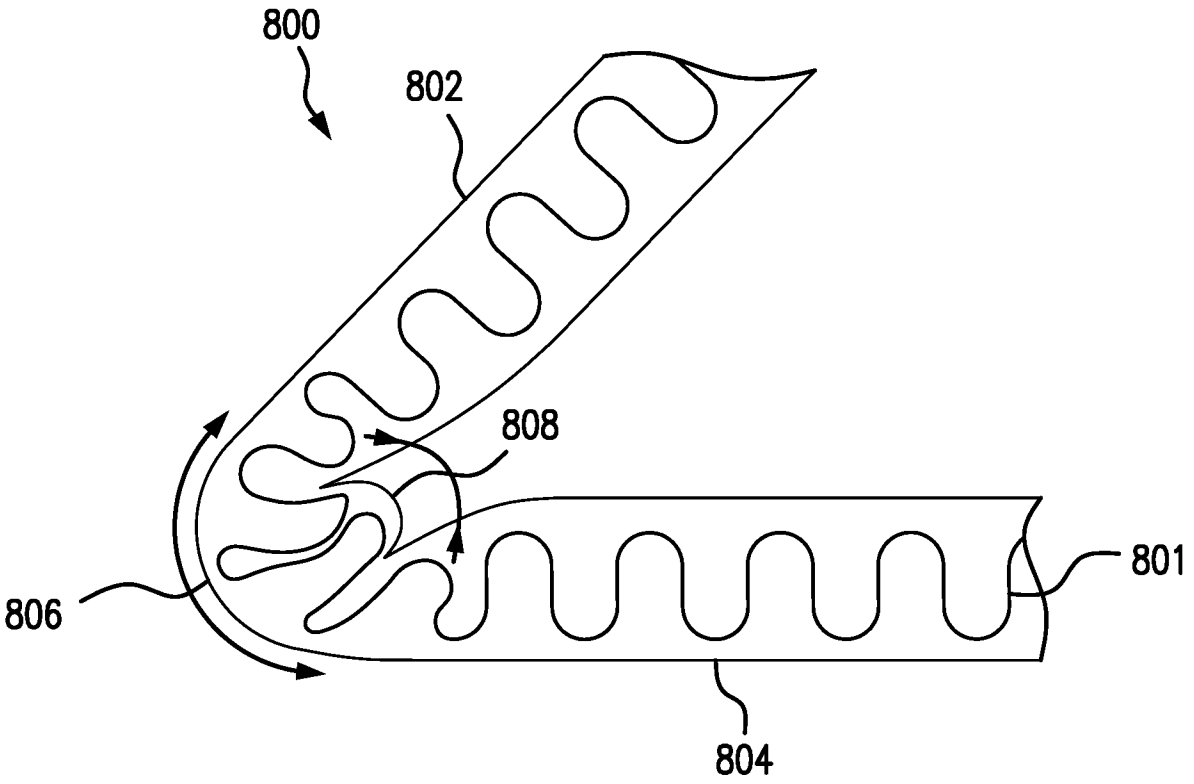
FIG. 8 shows a schematic view of a cardboard panel folded through to plastic deformation.

FIG. 8 shows a schematic diagram of a cardboard corrugate component using a creasing fold that may be used in the cushioning components described herein. As shown, corrugate 8 includes panel 802 and panel 804, folded at fold 806. Corrugate is shown as two liner sheets having fluting 801 between them. As shown, at fold 806, on the interior side of the fold, a bead 808 has formed. As illustrated by the curved line with outwardly facing arrows, the outer portion of the fold 806 is in tension, and the bead is formed in compression. During the creasing operation, as the bead forms, the fluting delaminates from the liner sheet, and the fold undergoes plastic deformation. This plastic deformation improves resiliency in the final product and provides for predictable spring response when used in the spring portion or stability wrap portion of the cushioning elements described. In this way, corrugate cardboard may be leveraged to be the primary or single component in cushioning elements as described, and as an alternative to foam or other non-recyclable cushioning components. Fold lines may be formed, for example, by weakening the substrate along the lines, such as by perforation, material crushing, scoring, miter cutting, or using a particular folding component, etc. With respect to the fluting shown in FIG. 8, the fold is shown parallel to the fluting folds, however in some embodiments the fold may be generally perpendicular to the fluting folds.

In some embodiments, the crease may be formed in the crease direction, that is parallel to the fluting folds. In this regard, generally folds of this type provide relatively more deflection than creases formed along the median direction (generally perpendicular to the fluting folds). To provide additional stiffness, creases may be formed along the median direction. With respect to flute-type generally, E-flute type (e.g., 1/16", 94 flutes per foot) provides relatively more deflection, while C-flute type (e.g., 5/32", 42 flutes per foot) provide additional stiffness. Once the crease is formed at a given fold with plastic deflection, if the ultimate fold is made in the direction of the crease, the fold generally provides for relatively more deflection—whereas if the fold is made in the reverse direction of the crease, additional stiffness may be provided. These crease/fluting properties may be tailored to a specific design goal, and include considerations related to how much deflection, stiffness, deceleration, size, etc., is required for a given cushioning element. Additional material considerations that may vary include tensile strength, compressive strength, burst strength, etc., which may be further adjusted by the board type, liner, and median parameters. In order to form the bead at the creases, properties of the material, flute direction or type, angle of flute, and material itself may be optimized.

Each spring portion of the cushioning elements described herein may be formed from folded cardboard as described. In summary, the fold(s) provided for the spring portions provide a force-deflection curve that may be designed to accommodate particular design requirements, such as "sway space". This is in view of a specification as to what amount of gravitational force equivalent (i.e., "g-force") is appropriate or acceptable for a given drop event. G-force is a measurement of the type of force per unit mass, e.g., acceleration, with one unit of g-force being the "g". One "g" is equal to the conventional value of gravitational acceleration on Earth, i.e., about 9.8 $m/s^2$. Based on a linear spring model with a constant slope, sway space is defined as two times the height of a drop divided by the number of g's acceptable for a product, and is a proxy for the amount of distance allowed for a product to travel (such as in a drop event) for a given acceptable g-force. In a linear spring, this is because the conservation of energy of a given force over the sway space distance, such that the height of a drop is one half of the acceptable g-force multiplied by the sway space.

Thus, rearranging for the sway space, for a linear spring model, it may be expressed as two times the height of a drop divided by the acceptable g-force.

With reference to FIGS. 6 and 7, the difference between X1 and X2 describes the sway space for a set of given design parameters (providing for acceptable deflection and resistance to a particular impact). In some embodiments, sway space may be defined as a non-linear model, e.g., if the spring is non-linear.

The resultant stiffness of each fold may be affected by several factors, such as whether the fold is parallel or perpendicular to the direction of the flute, what direction the fold is made with respect to a crease, crease tooling geometry, etc. When put together with several folds, the distance of deflection and repeatability increases for a given spring portion. As with single folds, stiffness of the final spring portion is also influenced by factors such as number of creases, length between creases, the angle of creases, and whether there is any pre-loading of the system. In general, as panel length between folds decreases, the system stiffness increases. Similarly, as the height of cushioning systems increase, they allow for additional deflection as compared to a shorter cushioning element holding other variables constant. And as additional folds are added, e.g., comparing the number of folds in one cushioning element to another, in general additional folds increase stiffness. In some embodiments, separate panels may be fixed to one another through adhesive or mechanical locks for example, and folds may be made with two panels in contact with each other thereby increasing stiffness of the cushioning element. By arranging springs in parallel, it is possible to impart additional structural stability, over a wider area (such as in the cushioning element of FIG. 7, for example). The retention wraps described herein may also increase distributed loading, and are affected by factors such as the angle of the crease, dimensions of the wrap, and whether there is any pre-loading of the system). In general, springs disposed in parallel impart additional stiffness to the cushioning elements, where as in series (e.g., stacked vertically on top of one another) additional deflection may be provided for. In considering arrangements for relatively heavy systems that may experience edge drops (e.g., a relatively narrow portion of the product dropping to an impact surface), disposing cushioning elements along the longitudinal axis of the edge may impart additional stiffness relative to an arrangement whereby cushioning elements are disposed perpendicularly to the edge (and also avoid a so-called "guillotining" effect).

While examples of spring portions described in example embodiments here focus on folded spring type features, other types of spring elements are contemplated. These include, but are not limited to, compression spring elements, tension spring elements, wave spring elements, leaf spring elements, column flex spring elements, pencil flex spring elements, etc. These types of features may be used singularly or in combination with any other of the types of spring elements. Additionally, while the examples provided describe particular fold directions or orientations, these may be further revised to accommodate particular cushioning element characteristics. Embodiments described herein achieve a resilient folded cardboard cushioning element, which means that they retain their overall height at least above 90% of their original height over multiple drops for a given product. In this regard, during impact testing, the weight applied may be scaled such that the weight applied is divided by an area of impact. In some embodiments, the weight applied over the area of impact during impact testing will equal the system weight divided by the surface area of the system to provide an accurate measurement of the resilience. In some embodiments, the cushioning elements described herein may each accommodate weights applied that are greater than 0.01 pound, greater than 0.25 pound, greater than 0.5 pound, greater than 1 pound, greater than 1.25 pounds, greater than 1.5 pounds, or greater than 2 pounds. In some embodiments, cushioning elements may retain greater than 90%, greater than 93%, greater than 95%, greater than 97%, and/or greater than 99% of their overall height over multiple drops for a given product. Coupling principles of resilience with the calculated sway space for a given package design allows for a robust cushioning system to be made from cardboard corrugate.

The relative significance of variables for the cardboard cushioning elements described herein has been determined. The number of folds (including stiffening folds) is significant from a stiffness perspective as described above. Similarly, the height of the spring also affects deflection and stiffness—additional height in general provides additional deflection. As will be appreciated, a spring that is too short may encounter a hardstack, i.e., the panels stack together and have an abrupt deceleration. The length between folds also affects stiffness and is a significant variable. Flute type and direction of the crease within the actual material (e.g., parallel or perpendicular to the fluting) are each also significant.

Figure 9:
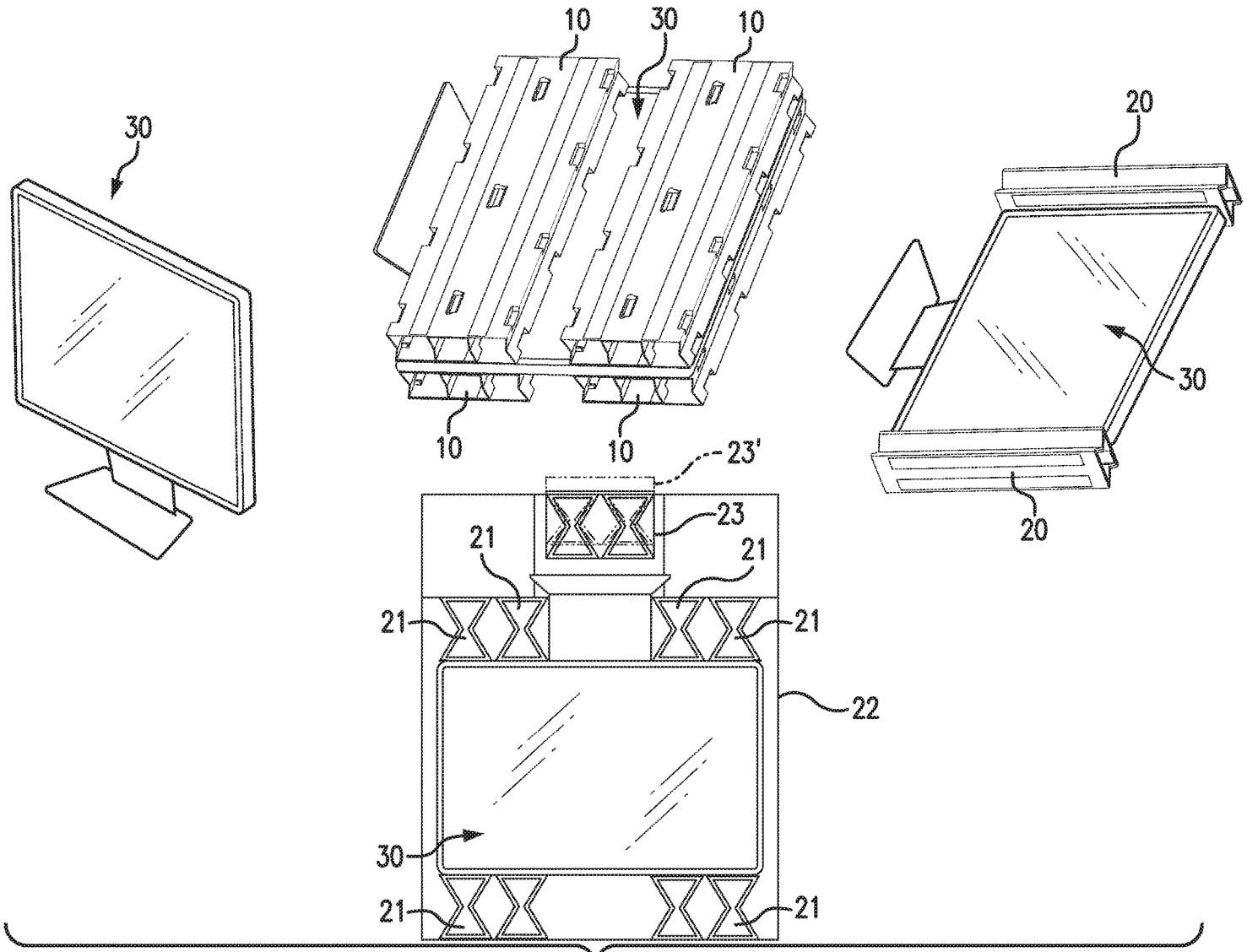
FIG. 9 shows a product with different placement options for packaging using the packaging components shown in FIGS. 1 and 4.

Turning to FIG. 9, an example of packaging 1 is shown. Packaging 1 includes product 30, e.g., a desktop computer or monitor. For clarity, FIG. 9 shows several views of product 30, with arranged cushioning elements, 10, 20, and 21 in respective positions. In practice, each of cushioning elements 10, 20, 21 may be applied around product 30, and packaging 1 may also include a lower receiving box and upper lid, for example. As shown in FIG. 9, relatively long and wide cushioning elements 10 may be applied to larger surfaces of product 30, such as a front or rear face of a display portion. To account for the larger surface area, cushioning element 10 may have a separate spring within a retention wrap, e.g., like the cushioning element shown in FIG. 1, for example. Along the edges of the display, cushioning elements 20 may be applied, along a longitudinal edge of the display as described above. This is advantageous in edge loading or edge drops, as stiffness is increased and the parallel configuration of cushioning elements 20 may avoid a guillotining effect. In some embodiments, an additional layer of stability wrap may be used to further bolster cushioning elements 20 against damage during edge drops. Finally, in some embodiments, cushioning elements 21 may be applied, e.g., under edges of a system that is designed to be floating within packaging 1. The lower loading surfaces of cushioning elements 21 may be in contact with another support structure of packaging 1, such that the lower pedestal stand of product 30 does not contact any other surface within packaging 1. This configuration allows for vertical travel of product 30 within packaging 1, while avoiding any load at all on the pedestal stand.

The packaging may include a finished goods box 22, enclosing the packaging, having a handle 23 configured to extend from a top side of the box. A further cushioning element 21 may be provided such that it is connected to the handle 23 on the interior of the finished goods box 22 and configured such that the handle 23 is kept near flush with the box. As a user pulls the handle 23 upward, e.g., to lift the box, the cushioning element 21 may compress and the handle 23 further extend upward from the box 22 so that the user may lift the box—an extended position of handle 23 is shown by element 23' in FIG. 9. This configuration keeps the handle 23 from being obtrusive in use, and provides a clean appearance of the finished goods packaging 22. When a user releases the handle 23, the cushioning element 21 pulls the handle 23 back into the box 22 as the spring element extends.

Similar to FIG. 5, FIG. 9 illustrates the modularity of the cushioning elements described herein. As shown, one or more specific cushioning elements may be used to provide cushioning and support to a product within a package, and may be placed in a modular fashion around the product. In some embodiments, cushioning elements described herein may be applicable to packaging for different products, and may be placed within packaging at different positions depending on which product is to be packaged. In this way, a modular packaging solution is provided, with the cushioning components being modular. FIG. 9 illustrates particular use cases for size and shape of the modular cushioning elements described herein. As described herein, the modular nature of the cushioning elements describe makes it so that they can be sized to fit within any gaps between a product and its outer box, and provide a modular cushioning solution without the use of foam.

During shipment, product may be received between multiple cushioning elements to retain and protect the product against impact and vibrations. In some embodiments, the cushioning elements may be positioned behind walls of the packaging, such that their structure is not visible to a consumer. The finished packaging may also include, for example, a base box to receive product during shipment. A lid may be provided to close the base box, or may be provided as a hinged element connected to the base box. In some embodiments, an array of products (or finished goods boxes, for example) may be disposed next to one another within a base box, and may be stacked on top of one another for shipment—cushioning elements described herein may be positioned between individual products within the array or a subset array to protect against vibration or impact events during shipment. A finished package may additionally include a tray, support structures, etc.

Figure 10:
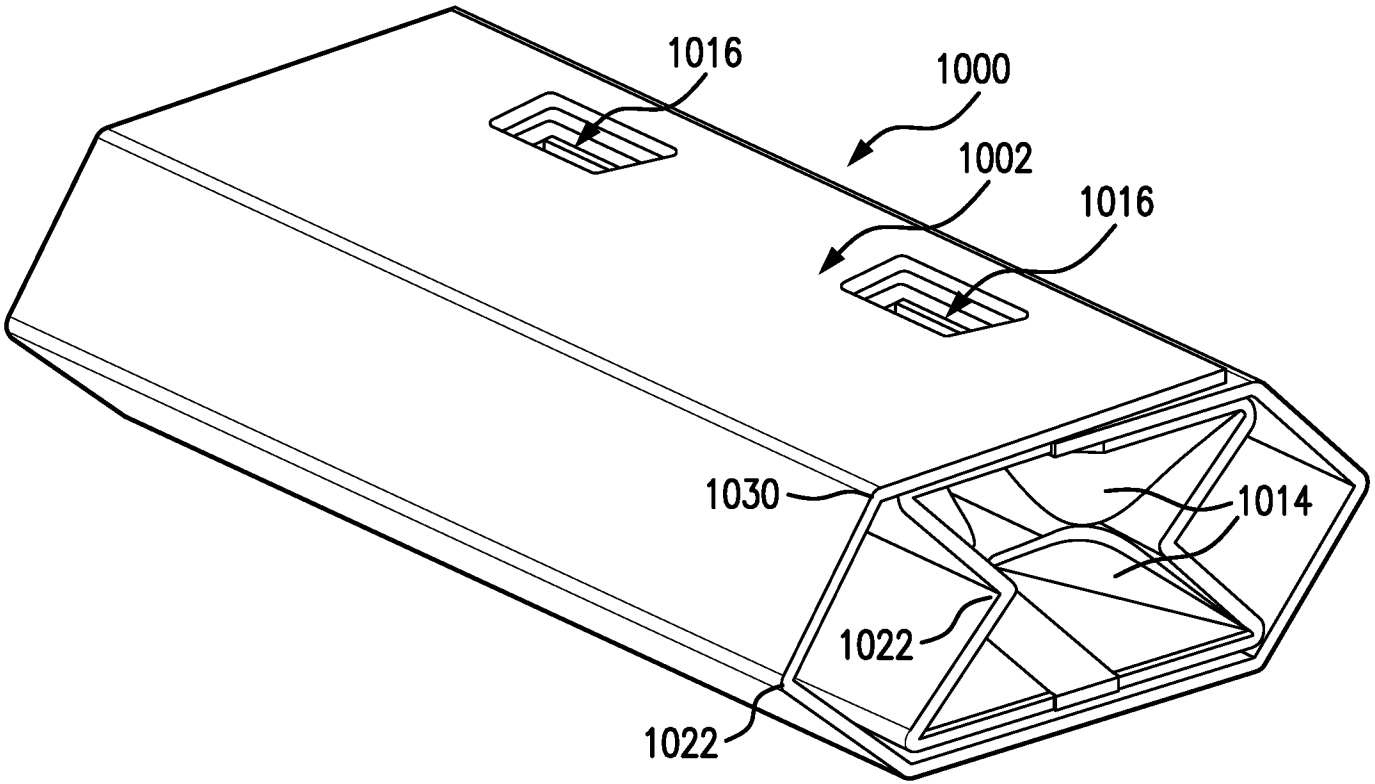
FIG. 10 shows a top isometric view of a packaging component in an embodiment, having folded tab stiffening elements.

Turning to FIG. 10, an additional cushioning element 1000 is provided. As with the other cushioning elements described herein, cushioning element 1000 includes a spring portion, folding at folds 1022, surrounded by loading surfaces 1002. Cushioning element includes mechanical locks shown at element 1016. FIG. 10 shows cushioning element 1000 with an alternative stiffening feature formed by folded tabs 1014. As shown in the figures, tabs 1014 include an additional fold at a terminal end of a panel fold, such that no punch through is formed through the panel surface. However, folded tab 1014 achieves a similar purpose as in other stiffening features described herein, whereby opposing panels are biased away from one another, further increasing the stiffness of the overall cushioning element, as described above with respect to tabs 114 and 214, for example. Cushioning element 1000 may include similar features as cushioning element 100 and 200, described herein.

Because the cushioning components may be composed of recyclable cardboard corrugate that is a biodegradable or compostable material, if the other materials used are also similarly biodegradable or compostable, if and when the customer opts to dispose of the packaging, the packaging may simply be recycled without requiring material separation (e.g., in a single-stream recycling program). Advantageously, this improves upon prior systems having, for example, expanded polystyrene, foams, or plastic film retention systems, which provide cushioning or impact protection but not afford an environmentally friendly solution. By designing the particular spring, stability wrap, and stiffening features for a particular product application, an environmentally friendly solution is provided it still results in secure packaging, resilient impact protection, and aesthetically pleasing packaging components.

Components of packaging 10, such as cushioning component 100, may be formed from one or more cardboard blanks. In some embodiments, the blank is formed of a single continuous substrate, such as, for example cellulose-based material like cardboard corrugate. Other cellulose-based materials are contemplated, such as paperboard, molded fiber components, or grayboard. In some embodiments, if there are surfaces of the cushioning component that contact a product or finished goods box directly, rather than through a wall of the packaging that hides the cushioning component for example, the cushioning component 100 may be surface treated or coated, for example with a coating to protect the finished good box, or product. Tabs, flaps, and regions without adhesive of the blank are folded such that no adhesive is visible in finished packaging 10. In some embodiments, adhesive may be omitted and the various flaps and tabs attached in another suitable manner (e.g., by mechanical interlock or press fit).

Cushioning elements 100, 200, 1000, and other variations described herein may include corresponding features described with reference to each of the other cushioning elements and features described without limitation.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. Packaging, comprising:

a cardboard cushion component comprising:

a folded cardboard spring portion that is deflectable;

a folded cardboard stability wrap portion that surrounds the folded cardboard spring portion and is in contact with terminal ends of the folded cardboard spring portion;

a stiffening element formed from cardboard and configured to increase the stiffness of the cardboard cushion component; and an upper loading panel and a lower loading panel, wherein the upper and lower loading panels are configured to deflect relative to one another in response to a loading force.

2. The packaging of claim 1, wherein the cardboard cushion component is formed from a single sheet of cardboard corrugate.

3. The packaging of claim 1, wherein the folded cardboard spring portion comprises a plastically deformed crease.

4. The packaging of claim 1, further comprising a plurality of the cardboard cushioning components arranged within a box and collectively supporting at least one product.

5. The packaging of claim 1, wherein the upper loading panel is connected to an upper side panel, the lower loading panel is connected to a lower side panel, each at a fold, and wherein a first stiffening element is cut out from adjacent portions of the upper loading panel and upper side panel, wherein the stiffening element is folded the opposite way as the fold between the upper loading panel and upper side panel.

6. The packaging of claim 5, wherein the folded cardboard spring portion further includes folds, and each folded edge of the folded cardboard spring portion comprises a plastically deformed crease on an inner surface of the fold.

7. The packaging of claim 1, wherein the folded cardboard stability wrap further comprises a folded tab configured to engage an aperture formed through the cardboard spring as a mechanical lock.

8. The packaging of claim 1, wherein the packaging does not use adhesive to form the cardboard cushion component.

9. A cardboard cushion component comprising:

a cardboard spring having a perimeter comprising: an upper panel;

a second panel extending inward from a first end of the upper panel;

a third panel extending inward from a second end of the upper panel;

a fourth panel extending outward from the second panel;

a fifth panel extending outward from the third panel; and a lower panel positioned parallel to the upper panel and extending from the fifth panel;

a cardboard retention wrap provided around the cardboard spring and engaged with the upper and lower panels of the cardboard spring; and a cardboard stiffening element that stiffens the cardboard cushion component.

10. The cardboard cushion component of claim 9, wherein the second, third, fourth, and fifth panels do not contact the cardboard retention wrap.

11. The cardboard cushion component of claim 9, wherein the cardboard cushion component is formed from a single sheet of cardboard corrugate.

12. The cardboard cushion component of claim 9, wherein the cardboard spring portion comprises a plastically deformed crease.

13. The cardboard cushion component of claim 9, wherein the cardboard retention wrap further comprises:

an upper panel in contact with the cardboard spring's upper panel;

a second panel extending inward from a first end of the retention wrap's upper panel;

a third panel extending inward from a second end of the retention wrap's upper panel;

a fourth panel extending outward from the retention wrap's second panel;

a fifth panel extending outward from the retention wrap's third panel; and a lower panel positioned parallel to the retention wrap's upper panel and extending from the retention wrap's fifth panel, the retention wrap's lower panel in contact with the spring's lower panel.

14. The cardboard cushion component of claim 9, wherein the first, second, third, fourth, and fifth panels of the cardboard retention wrap are in contact with the first, second, third, fourth, and fifth panels of the cardboard spring, respectively.

15. A cardboard cushion component comprising:

a first cardboard panel configured to be downwardly movable; and a second cardboard panel coupled to the first cardboard panel via a plurality of plastically deformed folds, such that the first and second cardboard panels are substantially coplanar in a first configuration at a first distance, wherein when a force, in excess of a product initial loading, is applied downward to the first cardboard panel and released, the first cardboard panel rebounds to at least 90% of the first distance.

16. The cardboard cushion component of claim 15, further comprising:

a cardboard stability component comprising:

a first component fixed to the first cardboard panel; and a second component fixed to the second cardboard panel, whereby the cardboard stability component prevents lateral motion of the first and second cardboard panels.

17. A packaging system comprising first and second cardboard cushioning components of claim 15, wherein a first cardboard cushion component's first cardboard panel and second cardboard panel have a first surface area, wherein a second cardboard cushion component's first cardboard panel and second cardboard panel have a second surface area larger than the first surface area, and wherein the first cardboard cushion component supports a product surface having a larger surface area than a product surface supported by the second cardboard cushion component.

18. The packaging system of claim 17, wherein each of the cardboard cushion components is formed from a separate single sheet of cardboard corrugate, respectively.

19. A packaging system comprising the cardboard cushion component of claim 15, wherein a plurality of first and second cardboard cushion components are positioned around a product such that they may absorb deflection along a plurality of directions, and wherein the plurality of first and second cardboard cushion components are arranged in an array within a box.

20. The packaging system of claim 19, wherein each of the cardboard cushion components is hidden from the customer in use by a wall of the packaging system.

* * * * *